US007083489B2

(12) United States Patent
Tsuji et al.

(10) Patent No.: US 7,083,489 B2
(45) Date of Patent: Aug. 1, 2006

(54) PLASMA DISPLAY PANELS MANUFACTURING METHOD AND SINTERING DEVICE

(75) Inventors: Hiroyasu Tsuji, Osaka (JP); Makoto Morita, Hyogo (JP); Masanori Suzuki, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 286 days.

(21) Appl. No.: 10/479,466

(22) PCT Filed: Jun. 9, 2003

(86) PCT No.: PCT/JP03/07253

§ 371 (c)(1),
(2), (4) Date: Dec. 2, 2003

(87) PCT Pub. No.: WO03/105176

PCT Pub. Date: Dec. 18, 2003

(65) Prior Publication Data

US 2004/0164928 A1 Aug. 26, 2004

(30) Foreign Application Priority Data

Jun. 10, 2002 (JP) ..... 2002-168770
Jun. 10, 2002 (JP) ..... 2002-168771

(51) Int. Cl.
*H01J 9/00* (2006.01)

(52) U.S. Cl. ..... 445/23; 445/25

(58) Field of Classification Search ..... 445/23–25
See application file for complete search history.

(56) References Cited

FOREIGN PATENT DOCUMENTS

| | | |
|---|---|---|
| JP | 1-60337 | 4/1989 |
| JP | 6-42884 | 2/1994 |
| JP | 6-58679 | 3/1994 |
| JP | 6-94375 | 4/1994 |
| JP | 2000-268737 | 9/2000 |
| JP | 2001-316186 | 11/2001 |
| JP | 2001-342075 | 12/2001 |

*Primary Examiner*—Joseph Williams
(74) *Attorney, Agent, or Firm*—Wenderoth, Lind & Ponack, L.L.P.

(57) ABSTRACT

Disclosed is a method of manufacturing PDPs, and a firing device that allows preferable firing of panel components by controlling each setter. Transportation structure configured by disposing rollers in a transport direction of a substrate allows firing of a panel component while transporting the substrate placed on a setter. An ID identification device for identifying a setter using an ID area provided on the setter is provided on a firing device. Panel components are fired using this firing device for controlling information such as a number of heatings of each setter.

20 Claims, 6 Drawing Sheets

PLASMA DISPLAY PANELS MANUFACTURING METHOD AND SINTERING DEVICE

TECHNICAL FIELD

The present invention relates to methods of manufacturing plasma display panels (PDPs) which are characterized as large-screen, thin, and lightweight display devices, and firing devices employed in their manufacture.

BACKGROUND ART

PDPs are gaining more attention recently as flat display panels since they have more advantageous features than liquid crystal panels, including faster display time, wider viewing angle, ease of manufacturing large screens, and higher display quality realized by self-light emission. PDPs are being used in an expanding range of contexts, including displays for public places and wide-screen display devices for domestic viewing.

In a PDP, gas discharge generates ultraviolet rays, and these ultraviolet rays excite phosphors, which then emit visible light for color display. PDP driving systems can be generally classified into AC and DC types. An electric discharge system can be classified into two types: surface discharge and opposed discharge. An AC surface discharge type that has a 3-electrode structure is a mainstream type with respect to higher definition, larger screens, and easier manufacture. A PDP of the AC surface discharge type that has a 3-electrode structure is configured with multiple pairs of display electrodes aligned in parallel on one substrate, address electrodes disposed on another substrate in a way so as to cross the display electrodes, barrier ribs, and phosphor layers. Since the phosphor layers can be made relatively thick, this type of PDP is appropriate for color displays using phosphors. A method of manufacturing PDPs includes steps of forming panel components such as an electrode, dielectric and phosphor one after another mainly using a step of forming a thick film on a surface of a front substrate and a rear substrate by repeating printing, drying and firing; and overlaying and sealing the front substrate and rear substrate on which these panel components are formed. In the above steps, a firing device is used for drying and firing.

As for the firing device, a so-called roller-hearth kiln, fit for mass production, is employed. The roller-hearth kiln has its transport structure configured by aligning multiple rollers in a direction of transportation of a substrate. While firing the panel components formed on the front and rear substrates, the substrates are placed on a support substrate called a setter (this state is hereafter called a firing target) during transportation for firing to prevent damage to each substrate by the transport structure. In addition, uniform heating of the substrate in its entirety is important when firing the panel components.

However, firing defects occur on the panel components in this type of firing device that seem to be caused by non-uniform heating of the substrate during firing. This appears to be caused by thermal deformation that accumulates in the setter due to repeated use of the setter. Non-uniform contact of the setter and rollers, which are the transportation structure, impedes smooth transportation by meander or deviation, resulting in non-uniform heating while firing a substrate.

The present invention is designed to solve this disadvantage, and aims to offer a method of manufacturing PDPs and a firing device employed in this manufacture that achieve satisfactory firing of panel components by controlling each setter.

SUMMARY OF THE INVENTION

To achieve the above object, a method of manufacturing PDPs of the present invention includes steps of firing a substrate at a predetermined temperature while the substrate on which panel components are formed is placed on a setter and transported by transportation structure configured with multiple rollers; and identifying and controlling each setter based on identification information in an ID area provided on each setter.

This method allows control of information on the setter to be used in firing for identifying a number of use in a firing process so as to solve a problem of non-uniform firing due to thermal deformation of the setter. Accordingly, a method of manufacturing high-quality PDPs at a high yield is achievable.

DETAILED DESCRIPTION OF PREFERRED EMBODIMENT(S)

An exemplary embodiment of the present invention is described below with reference to drawings.

Figure 1:
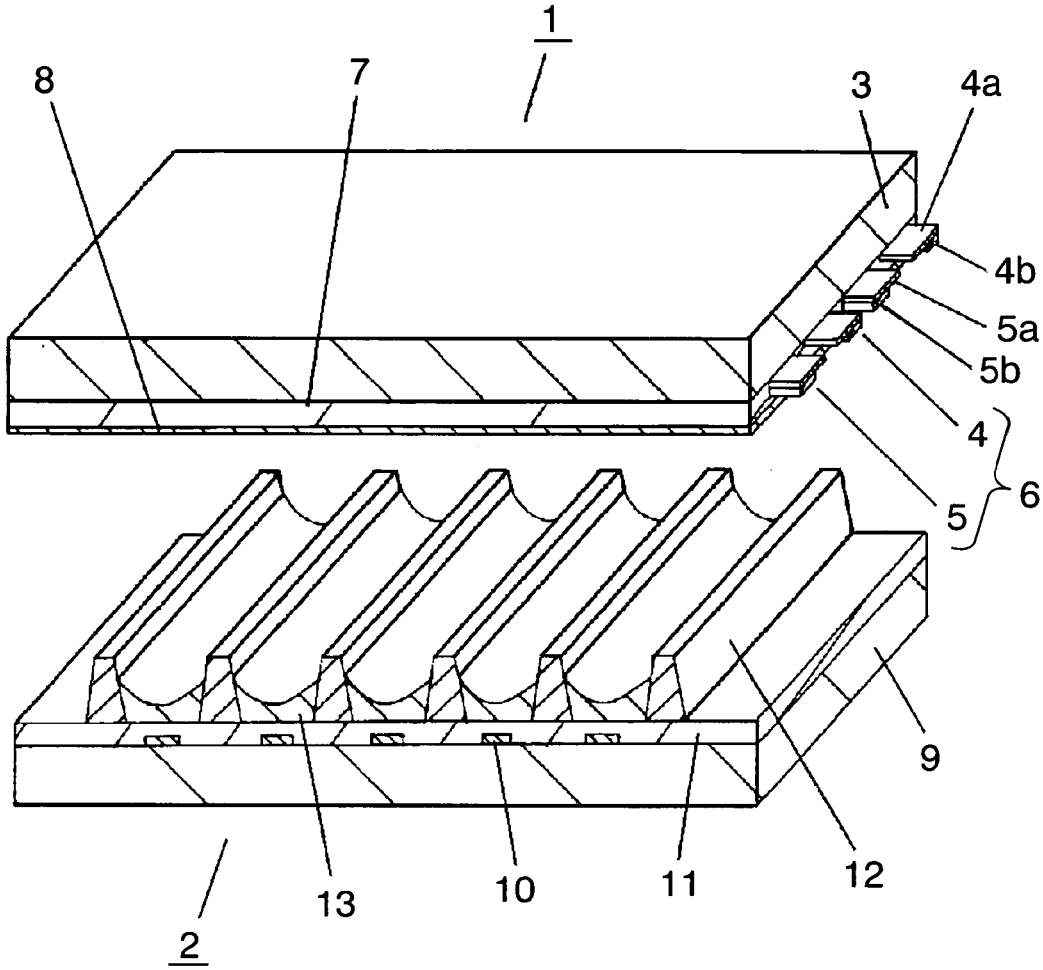
FIG. 1 is a sectional perspective view of a PDP structure.

FIG. 1 shows a structure of a PDP manufactured using a method of manufacturing PDPs of the present invention. The PDP is configured with front substrate 1 and rear substrate 2. Front substrate 1 consists of striped display electrodes 6 including a pair consisting of scanning electrode 4 and susutain electrode formed on transparent insulating substrate 3 such as a glass substrate made of borosilicate sodium glass using a float process, dielectric layer 7 covering display electrodes 6, and protective film 8 made of MgO formed on dielectric layer 7. Scanning electrode 4 and sustain electrode 5 are, for example, configured by transparent electrodes 4*a* and 5*a* made of a transparent conductive material such as ITO, and bus electrodes 4*b* and 5*b* made of, for example, Ag which are electrically coupled to these transparent electrodes 4*a* and 5*a*.

Rear substrate 2 consists of address electrodes 10 formed, in a direction orthogonal to display electrodes 6, on substrate 9 in a way facing substrate 3 of front substrate 1, dielectric layer 11 covering the address electrodes 10, multiple striped barrier ribs 12 parallel to and between address electrodes 10 on dielectric layer 11, and phosphor layer 13 formed between these barrier ribs 12. For color display, red, green, and blue are in general disposed sequentially in phosphor layers 13.

A sealing member (not illustrated) forms a seal around front substrate 1 and rear substrate 2 such that display electrodes 6 and address electrodes 10 cross at right angles, and such that a small discharge space is secured therebetween. In the discharge space, discharge gas such as a mixture of neon (Ne) and xenon (Xe) is enclosed. The discharge space is partitioned into multiple blocks by barrier ribs 12. Multiple discharge cells are thus formed between barrier ribs 12, and these discharge cells are unit luminescence regions.

Electric discharge occurs as a result of voltage periodically applied to address electrodes 10 and display electrodes 6. Ultraviolet rays generated by this electric discharge irradiate phosphor layer 13, where they are converted to visible light for image display.

Figure 2:
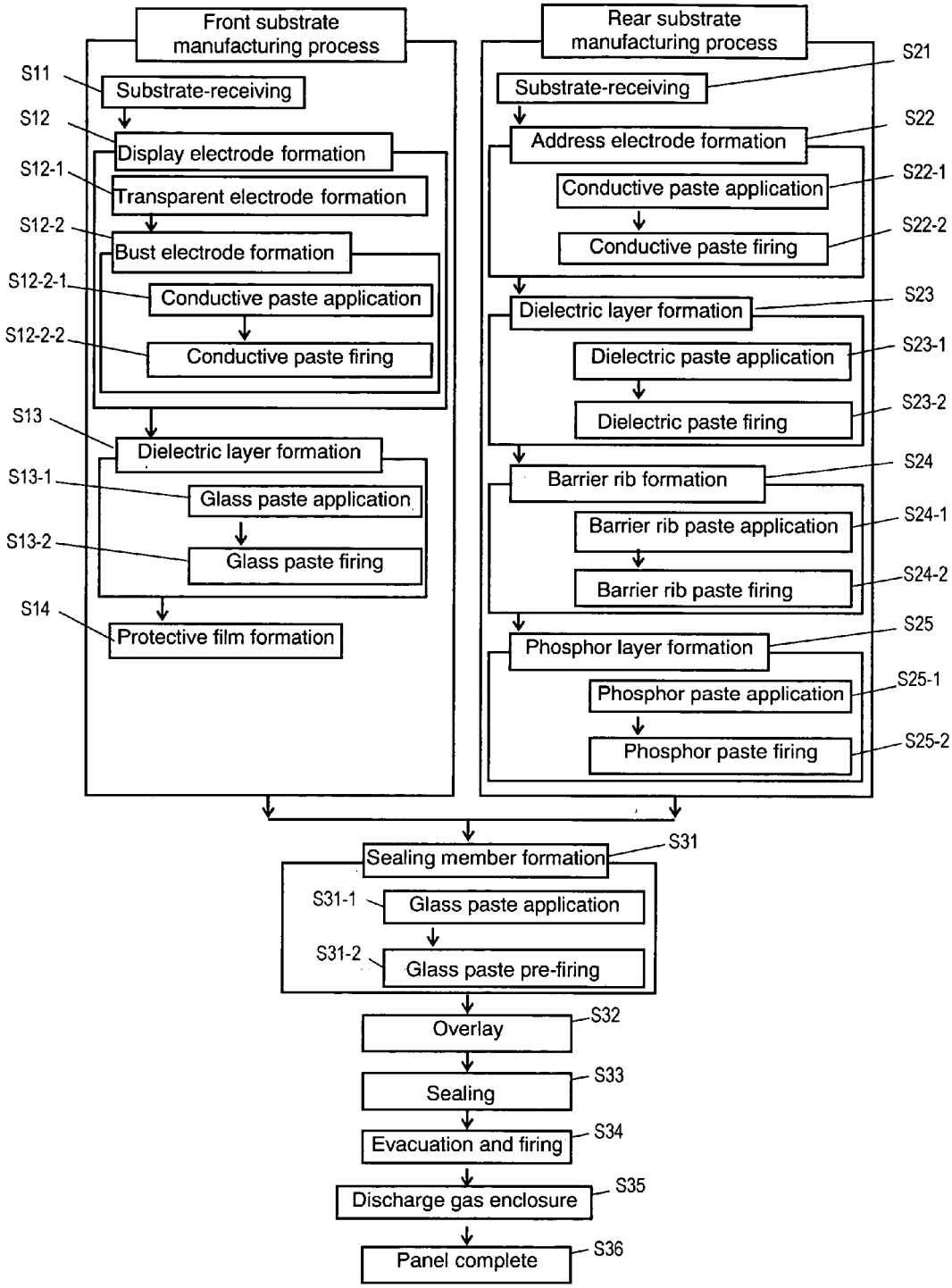
FIG. 2 is a process chart of a method of manufacturing PDPs in accordance with an exemplary embodiment of the present invention.

Next, a method of manufacturing the PDP as configured above is described with reference to FIG. 2, which shows steps in a method of manufacturing PDPs in an exemplary embodiment of the present invention.

First, a process of manufacturing the front substrate, i.e., front substrate 1, is described. After substrate-receiving step (S11) to receive substrate 3, a step of forming display electrodes (S12) is executed to form display electrodes 6 on substrate 3. The step of forming display electrodes (S12) includes a step of forming transparent electrodes (12-1) for forming transparent electrodes 4*a* and 5*a*, and a subsequent step of forming bus electrodes for forming bus electrodes 4*b* and 5*b*. The step of forming bus electrodes (S12-2) includes a step of applying conductive paste (S12-2-1) for applying conductive paste such as Ag by screen-printing and a step of firing conductive paste (S12-2-2) for firing the conductive paste applied. Then, after the step of forming display electrodes (S12), a step of forming dielectric layer (S13) is executed to form dielectric layer 7 to cover display electrodes. The step of forming dielectric layer (S13) includes a step of applying glass paste (S13-1) for applying paste including lead-system glass material [whose composition is, for example, 70 wt % lead oxide (PbO), 15 wt % boron oxide ($B_2O_3$), and 15 wt % silicon oxide ($SiO_2$)] by screen-printing, and a step of firing glass paste (S13-2) for firing the glass material applied. Then, a step of forming protective film (S14) is executed to form protective film 8 of magnesium oxide (MgO), for example, by vacuum deposition on the surface of dielectric layer 7 to complete manufacture of front substrate 1.

Next, a process of manufacturing the rear substrate, i.e., rear substrate 2, is described. After a step of receiving (S21) for receiving substrate 9, a step of forming address electrodes (S22) is executed to form address electrodes 10 on substrate 9. This step (S22) includes a step of applying conductive paste (S22-1) for applying conductive paste of Ag, for example, by screen-printing, and a subsequent step of firing this applied conductive paste (S22-2). A step of forming dielectric layer (S23) is then executed to form dielectric layer 11 on address electrodes 10.

This step (S23) includes a step of applying dielectric paste (S23-1) for applying dielectric paste containing titanium oxide ($TiO_2$) particles and dielectric glass particles typically by screen-printing, and a subsequent step of firing this applied dielectric paste (S23-2). Then, a step of forming barrier ribs (S24) for forming barrier ribs 12 on dielectric layer 11 between address electrodes 10 is executed. This step (S24) includes a step of applying barrier paste (S24-1) for applying barrier paste containing glass particles typically by printing and a subsequent step of firing barrier paste (S24-2) for firing this applied barrier paste. A step of forming phosphor layer (S25) for forming phosphor layer 13 between barrier ribs 12 is then executed. This step (S25) includes a step of applying phosphor paste (S25-1) for making color phosphor paste of red, green, and blue, and applying the phosphor paste of these colors between barrier ribs 12, and a subsequent step of firing this applied phosphor paste (S25-2). Rear substrate 2 is completed through these steps.

Next, a step of sealing front substrate 1 and rear substrate 2 manufactured as above and a step of evacuating and enclosing discharge gas are described.

A step of forming sealing member (S31) for forming a sealing member made of glass frit on one or both of front substrate 1 and rear substrate 2 is executed. This step (S31) includes a step of applying glass paste for sealing (S31-1) and a step of pre-firing glass paste (S31-2) for tentatively firing this applied glass paste to remove a resin constituent in the glass paste applied. Then, an overlaying step (S32) is executed to overlay two substrates such that display electrodes 6 on front substrate 1 and address electrodes 10 on rear substrate 2 cross at right angles. A sealing step (S33) is then executed to soften the sealing member by heating both substrates overlaid for sealing. After an evacuating and firing step (S34) is executed to fire this panel while evacuating a small discharge space created between these sealed substrates, a step of enclosing discharge gas (S35) is executed to enclose discharge gas under a predetermined pressure so as to complete PDP (S36).

In the manufacture of the PDP, as described above, a firing process is often applied when forming panel components such as bus electrodes 4*b* and 5*b*, dielectric layer 7, address electrode 10, dielectric layer 11, barrier rib 12, phosphor layer 13, and a sealing member (not illustrated). A firing device employed in these firing processes is described below.

Figure 3:
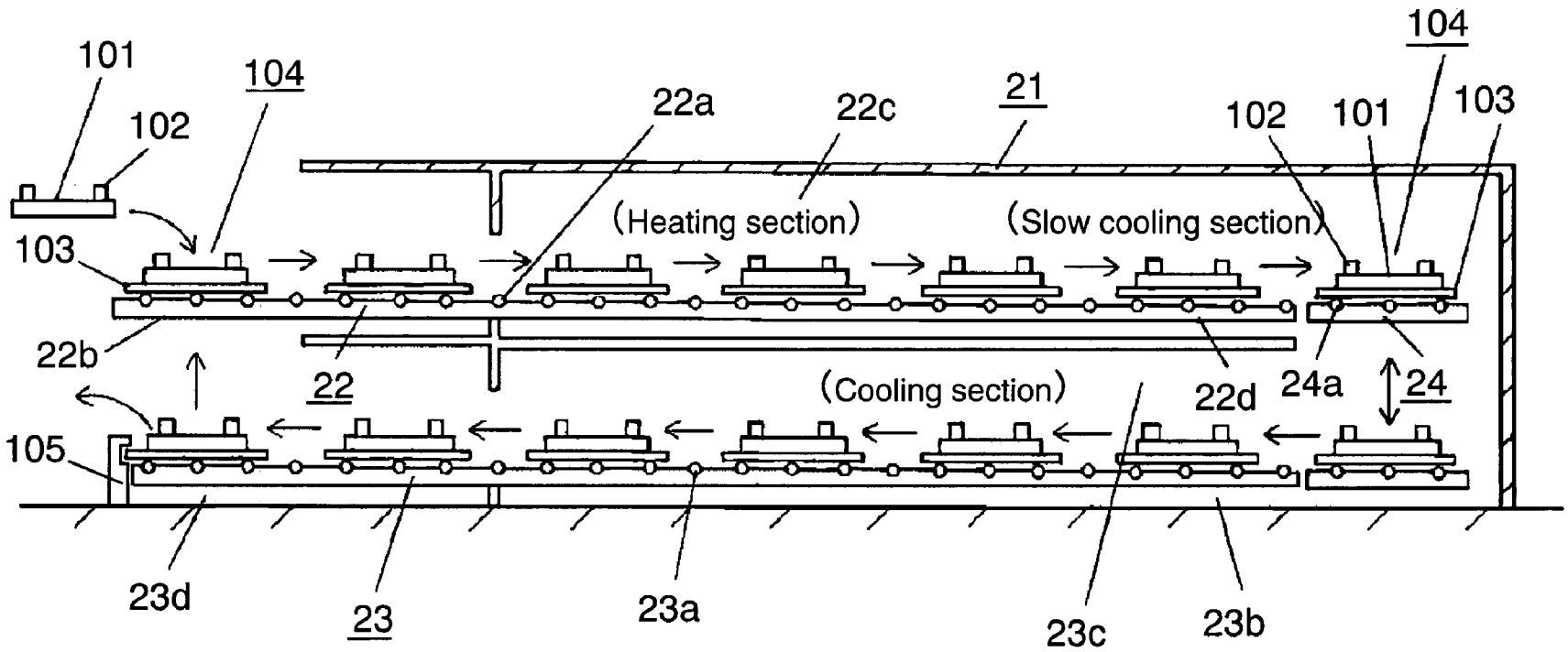
FIG. 3 is a sectional view of a structure of a firing device for PDPs in accordance with the exemplary embodiment of the present invention.

FIG. 3 is a sectional view of the firing device used in the method of manufacturing PDPs in the exemplary embodiment of the present invention. Firing device 21 includes outward transportation structure 22 in which multiple rollers 22*a* are aligned in a transporting direction, return transportation structure 23 in which multiple rollers 23*a* are aligned in a transporting direction, and elevating structure 24 in which multiple rollers 24*a* are aligned in a transporting direction and also configured so as to enable rollers 24*a* to be elevated between outward transportation structure 22 and return transportation structure 23.

Substrate 101, i.e., front substrate 1 or rear substrate 2, of the PDP on which panel components 102 such as bus electrodes 4*b* and 5*b*, dielectric layer 7, address electrode 10, dielectric layer 11, barrier rib 12, phosphor layer 13, or the sealing member (not illustrated) are formed is placed on setter 103 which is a support substrate, and transported by outward transportation structure 22. Setter 103 is provided so as to prevent damage to substrate 101. A structure in which substrate 101 is placed on setter 103 is hereafter called firing target 104.

In the above configuration, a characteristic of the exemplary embodiment is that an individual identification area, i.e., ID area, for self-identification is provided on setter 103, and firing device 21 has individual identification area recognition structure 105, i.e., ID area identification structure, for identifying information in the individual identification area of setter 103.

Figure 4:
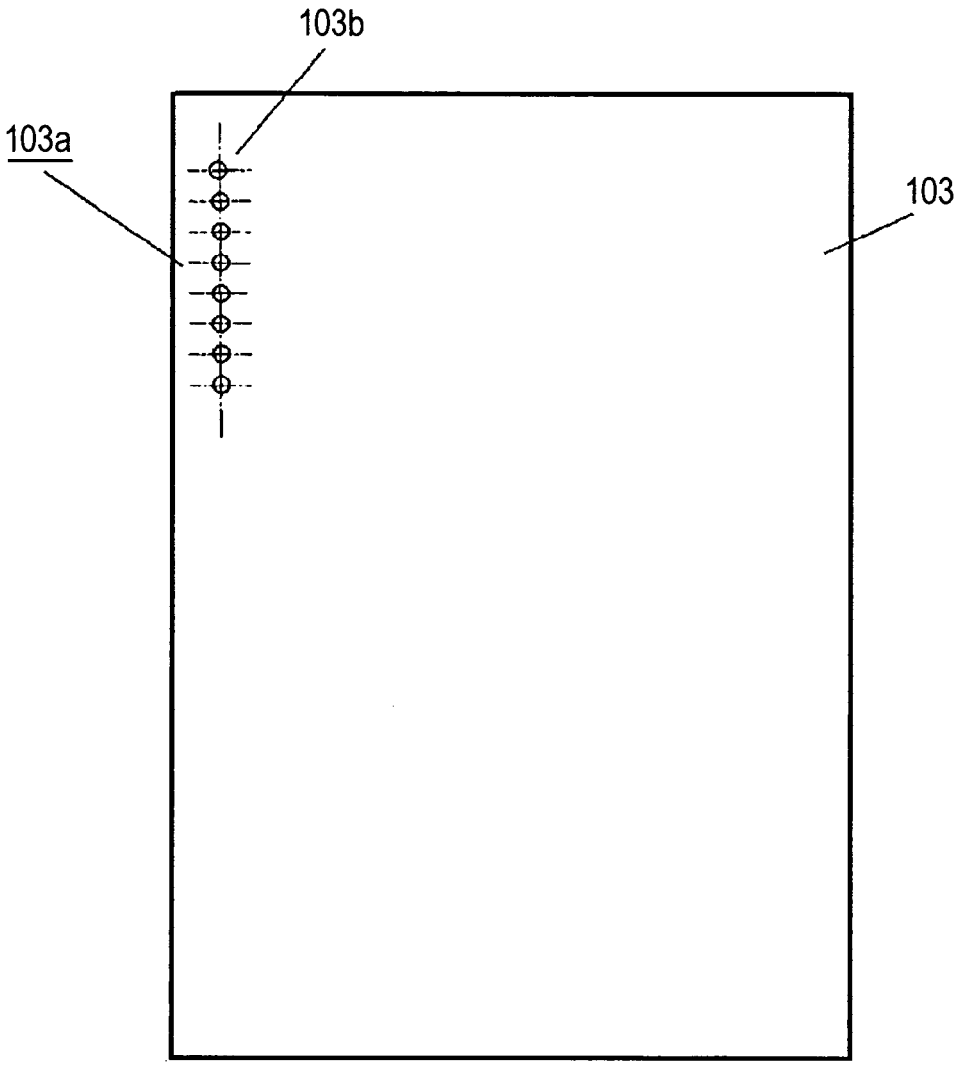
FIG. 4 is an example of an individual identification area of a setter in a firing device for PDPs in accordance with the exemplary embodiment of the present invention.

FIG. 4 shows an example of the individual identification area provided on setter 103. One example of the individual identification area on setter 103 is configured with a change in optical transmittance such as a combination of through holes (which naturally has a high optical transmittance) and other parts. Individual identification area 103*a* is provided on a periphery of setter 103. This individual identification area 103*a* is configured by a combination of presence of through holes 103*b* provided on setter 103. For example, if a combination of a number of through holes is practically changed for each setter 103 at n number of points to provide through holes, individual identification information can be provided to $2^n$ setters.

Figure 5:
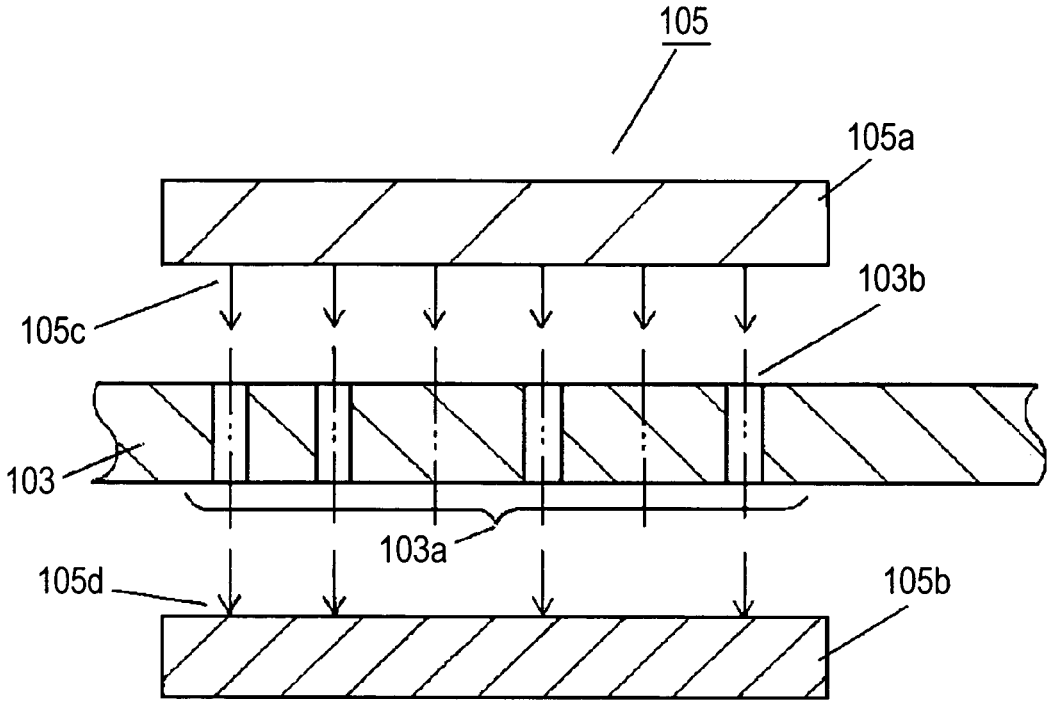
FIG. 5 is a brief configuration of an identification device in the firing device for PDPs for the individual identification area in accordance with the exemplary embodiment of the present invention.

FIG. 5 shows an example of the individual identification area recognition structure in the PDP firing device. As shown in FIG. 5, individual identification area recognition structure 105 can be configured by combining light-emitting element 105*a* and light-receiving element 105*b* disposed facing each other with individual identification area 103*a* of setter 103 therebetween. Exiting light 105*c* emitted from light-emitting element 105*a* passes via through hole 103*b*, for example, provided on individual identification area 103*a* of setter 103, and enters light-receiving element 105*b* as transmitted light 105*d*. Each setter 103 can be identified by its pattern of transmitted light 105*d* that enters. If eight recognition points such as through holes 103*a* are provided, 28 setters are identifiable.

A firing process for firing firing target 104 using setter 103 having individual identification area 103*a*, and firing device 21 having individual identification area recognition structure 105, as mentioned above, is described below with reference to FIG. 3. First, firing target 104 is placed on transport start 22*b* of outward transportation structure 22. Outward transportation structure 22 guides firing target 104 to upper passage 22*c* of firing device 21, and a heating device such as a heater (not illustrated) provided inside upper passage 22*c* heats firing target 104 to a predetermined firing temperature in a heating section for firing, while the firing target continues to be transported by outward transportation structure 22. Then, in a slow-cooling section, firing target 104 is cooled while being transported toward end 22*d* of outward transportation structure 22. Firing target 104 is further transported beyond transport end 22*d* of outward transportation structure 22, and reaches elevating structure 24. Firing target 104 reaching elevating structure 24 is lowered to a level connected to return transportation structure 23 by elevating structure 24, and transferred to transport start 23*b* of return transportation structure 23 by being transported in a reverse direction to the transportation direction of outward transportation structure 22. Then, return transportation structure 23 transports firing target 104 in lower passage 23*c*, i.e., a cooling section, to cool firing target 104 to a normal temperature. When firing target 104 reaches transport end 23*d* of return transportation structure 23, substrate 101 being fired is removed from setter 103. Empty setter 103 moves to transport start 22*b* of outward transportation structure 22 in the upper stage again, and next substrate 101 is placed and guided on upper passage 22*c* for firing.

Here, individual identification area recognition device 105 provided in firing device 21 recognizes the individual identification information of setter 103 in firing target 104 reaching transport end 23*d*. A separately provided processor (not illustrated) accumulates recognized individual identification information and monitors a history of setter 103 such as a number of firings and heatings in firing processes for each panel component. A threshold, such as for a number of uses, is set for setter 103, related to a number of firings; and setter 103 whose information identified at transport end 23*d* exceeds this threshold is not reloaded to the upper passage. Instead, this setter 103 is ejected for maintenance or disposal. Such system for excluding setter 103 used beyond a predetermined number of firings allows accumulated thermal deformation of setter 103 due to repeated firing to be kept below a predetermined level. As a result, occurrence of meandering or deviation during transportation, thought to be caused by deformation of setter 103 due to thermal deformation accumulated during repeated firings is reduced, thereby achieving smooth transportation. Accordingly, panel component 102 can be fired in an optimal state.

Moreover, the firing device of the present invention has a function for correcting positional deviation of setter 103 for ensuring smooth transportation of setter 103. A positioning device is provided on the transportation structure as a positional deviation correcting function, and slidability between a roller and setter is also improved.

Figure 6A:
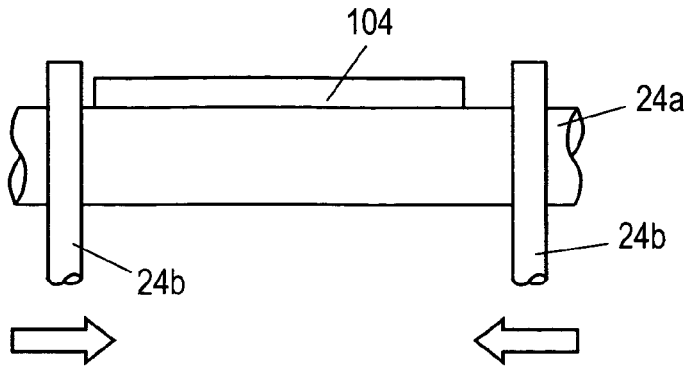
FIGS. 6A–6D show brief configurations of a positioning device in an elevating structure of the firing device for PDPs in accordance with the exemplary embodiment of the present invention.
Figure 6B:
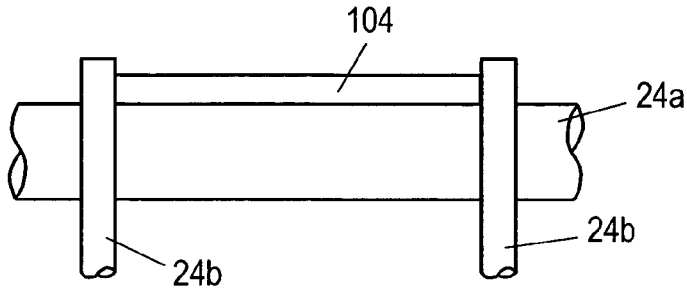
Figure 6C:
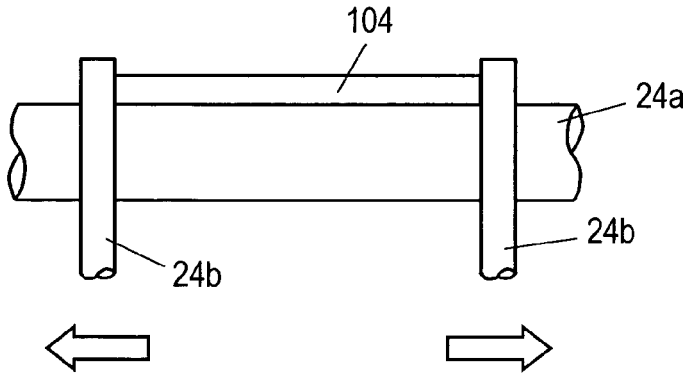
Figure 6D:
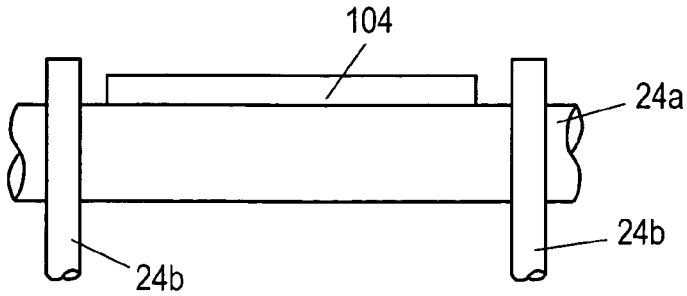

FIGS. 6A–6D are schematic views of the positioning device, provided in the elevating structure, of the firing device in the exemplary embodiment of the present invention. A position of firing target 104, including setter 103 on the rollers, is more likely to deviate when changing direction in the transportation structure. For example, positional deviation often occurs at a point of changing from horizontal transportation to vertical transportation. FIGS. 6A–6D show an example of the positioning device provided on elevating structure 24, seen from the front with respect to the transportation of firing target 104 by elevating structure 24. In FIGS. 6A–6D, a shape of firing target 104 is simplified to facilitate understanding. When firing target 104 is loaded to elevating structure 24, as shown in FIG. 6A, positioning guide 24*b* such as a pin between rollers 24*a* contacts setter 103 of firing target 104. At this point, firing target 104 is positioned while it is being placed on rollers 24*a*. Positional deviation of firing target 104 also often occurs when firing target 104 is lowered by elevating structure 24. Therefore, firing target 104 is lowered while being positioned by positioning guide 24*b*, as shown in FIG. 6C; and positioning by positioning guide 24*b* is then released, as shown in FIG. 6D. Firing target 104, released from positioning guide 24*b*, is moved and transferred from elevating structure 24 to return transportation structure 23.

To apply the above positioning, the firing device of the present invention adopts materials in optimal combination with respect to relative slidability of rollers 22*a*, 23*a*, and 24*a*, and setter 103. A specific example of a combination of materials which demonstrates good relative slidability is use of a material mainly containing silicon carbide (SiC) for rollers 22*a*, 23*a*, and 24*a* (hereafter SiC rollers) and crystal glass with a low expansion coefficient, such as Neoceram N-0 (product name) by Nippon Electric Glass, for setter 103 (hereafter 'Neoceram setter').

Each SiC roller is formed into a roller shape after mixing silicon carbide (SiC) powder and binder, and then silicon (Si) material is added and fired to melt the silicon (Si) material into the roller. Constituents are defined by 2 to 50 wt % of silicon (Si) metal, silicon (Si) silicon monocarbide (SiC) containing 98 to 50 wt % of silicon carbide (SiC). Neoceram contains 50 to 65 wt % of silicon oxide ($SiO_2$), 1 to 15 wt % of aluminum oxide ($Al_2O_3$), and a very small amount of lithium (Li).

Positioning of setter 103, as described above, eliminates a need for lifting firing target 104 from rollers 24*a*, and thus several elevating and lowering steps for firing target 104 with respect to positioning are eliminated. In addition, the positioning device can adopt a simple structure. Still more, since rollers 24*a* and setter 103 demonstrate good slidability, abrasion powder generated between these members can be reduced. Accordingly, a PDP with higher quality and yield can be manufactured by eliminating a mixture of foreign particles with PDP components.

In the above exemplary embodiment, the positioning device is provided on the elevating structure. Since this positioning device can be easily configured, it can be easily provided mainly at areas where positional deviation occurs frequently in the transportation structure.

The method of manufacturing the PDP and the firing device of the present invention thus suppresses positional deviation of the firing target due to deformation of the setter by controlling individual information such as a heat history of each setter. Furthermore, the positional deviation of the firing target is corrected by providing the positioning device. Accordingly, firing targets are uniformly fired so as to achieve uniform quality.

It is apparent that individual control of the setters and positioning can be integrated or separately implemented.

INDUSTRIAL APPLICABILITY

The present invention controls each setter, for achieving a method of manufacturing PDPs, and a firing device used in this manufacture that enables preferable firing of panel components.

The invention claimed is:

1. A method of manufacturing a plasma display panel, comprising:

using a plurality of rollers to transport a setter supporting a substrate having thereon a panel component;

while transporting said setter, firing said panel component at a predetermined temperature;

identifying said setter using identification information in an ID area of said setter; and performing one of maintenance and disposal of said setter when identifying said setter using said identification information indicates that a threshold value has been exceeded.

2. The method according to claim 1, wherein identifying said setter using identification information comprises identifying said setter using said identification information to determine historical information pertaining to firing of said setter.

3. The method according to claim 2, wherein identifying said setter using said identification information to determine historical information pertaining to firing of said setter comprises identifying said setter using said identification information to determine the number of times said setter has been fired, such that performing one of maintenance and disposal of said setter when identifying said setter indicates that a threshold value has been exceeded comprises performing one of maintenance and disposal of said setter when identifying said setter indicates that the number of times said setter has been fired exceeds a threshold value.

4. The method according to claim 3, wherein identifying said setter using said identification information comprises identifying said setter using a combination of points with different optical transparencies.

5. The method according to claim 4, wherein identifying said setter using a combination of points with different optical transparencies comprises identifying said setter using a combination of (i) through holes extending in a thickness direction of said setter, and (ii) non-through hole portions, with said through holes corresponding to points having an optical transparency different than an optical transparency of said non-through hole portions.

6. The method according to claim 5, wherein identifying said setter using said combination of (i) through holes extending in a thickness direction of said setter, and (ii) non-through hole portions, comprises passing through said through holes light emitted from a light-emitting element, and receiving said light by a light-receiving element.

7. The method according to claim 2, wherein identifying said setter using said identification information comprises identifying said setter using a combination of points with different optical transparencies.

8. The method according to claim 7, wherein identifying said setter using a combination of points with different optical transparencies comprises identifying said setter using a combination of (i) through holes extending in a thickness direction of said setter, and (ii) non-through hole portions, with said through holes corresponding to points having an optical transparency different than an optical transparency of said non-through hole portions.

9. The method according to claim 8, wherein identifying said setter using said combination of (i) through holes extending in a thickness direction of said setter, and (ii) non-through hole portions, comprises passing through said through holes light emitted from a light-emitting element, and receiving said light by a light-receiving element.

10. The method according to claim 1, wherein identifying said setter using identification information comprises identifying said setter using a combination of points with different optical transparencies.

11. The method according to claim 10, wherein identifying said setter using a combination of points with different optical transparencies comprises identifying said setter using a combination of (i) through holes extending in a thickness direction of said setter, and (ii) non-through hole portions, with said through holes corresponding to points having an optical transparency different than an optical transparency of said non-through hole portions.

12. The method according to claim 11, wherein identifying said setter using said combination of (i) through holes extending in a thickness direction of said setter, and (ii) non-through hole portions, comprises passing through said through holes light emitted from a light-emitting element, and receiving said light by a light-receiving element.

13. A firing apparatus for a plasma display panel, comprising:

transportation structure including rollers aligned in a transport direction;

firing structure for heating and firing a substrate, on which is a panel component, while the substrate is supported by a setter being transported by said rollers; and ID identification structure for identifying the setter using an ID area of the setter, so as to control the setter.

14. The firing apparatus according to claim 13, wherein said ID identification structure is for identifying the setter using an ID area of the setter by using an ID area configured from points having different optical transparencies in a thickness direction of the setter, and said ID identification structure includes a light-emitting element and a light-receiving element facing each other such that the ID area can be positioned therebetween.

15. The firing apparatus according to claim 14, wherein said ID identification structure is for identifying the setter using an ID area configured from points with different optical transparency in a thickness direction of the setter by identifying the setter using an ID area configured from (i) through holes extending in the thickness direction of the setter, and (ii) non-through hole portions, with the through holes corresponding to points having an optical transparency different than an optical transparency of the non-through hole portions.

16. The firing apparatus according to claim 15, wherein said ID identification structure is for identifying the setter using an ID area configured from (i) through holes extending in the thickness direction of the setter, and (ii) non-through hole portions, by passing through said through holes light emitted from said light-emitting element, and receiving said light by said light-receiving element.

17. A firing system for a plasma display panel, comprising:

a setter having an ID area; and a firing apparatus including (i) transportation structure including rollers aligned in a transport direction;

(ii) firing structure for heating and firing a substrate, on which is a panel component, while the substrate is supported by said setter and said setter is transported by said rollers; and (iii) ID identification structure for identifying said setter using said ID area of said setter, so as to control said setter.

18. The firing system according to claim 17, wherein said ID area of said setter is configured from points having different optical transparencies in a thickness direction of said setter, such that said ID identification structure is for identifying said setter using said points having different optical transparencies, and said ID identification structure includes a light-emitting element and a light-receiving element facing each other such that said ID area can be positioned therebetween.

19. The firing system according to claim 18, wherein said points having different optical transparencies comprise (i) through holes extending in the thickness direction of said setter, and (ii) non-through hole portions, with said through holes corresponding to points having an optical transparency different than an optical transparency of said non-through hole portions.

20. The firing system according to claim 19, wherein said ID identification structure is for identifying the setter using an ID area configured from (i) through holes extending in the thickness direction of the setter, and (ii) non-through hole portions, by passing through said through holes light emitted from said light-emitting element, and receiving said light by said light-receiving element.

* * * * *